US005154405A

United States Patent [19]

Graveson et al.

[11] Patent Number: 5,154,405

[45] Date of Patent: Oct. 13, 1992

[54] STOPPING DEVICE FOR ENVELOPE TURNER

[75] Inventors: Sandra J. Graveson, Waterbury; Joseph H. Marzullo, Brookfield; Christopher DeBarber, Woodbury; Michael D. Ballard, Sandyhook; Curtis L. Mrozinski, Newtown, all of Conn.

[73] Assignee: Pitney Bowes Inc., Stamford, Conn.

[21] Appl. No.: 738,987

[22] Filed: Aug. 1, 1991

[51] Int. Cl.[5] ..... B65H 9/06

[52] U.S. Cl. ..... 271/2; 271/184; 271/225; 271/245

[58] Field of Search ..... 271/2, 225, 245, 184, 271/185

[56] References Cited

U.S. PATENT DOCUMENTS 4,724,945 2/1988 Martin ..... 271/225 X 4,911,422 3/1990 Auerbach ..... 271/2 X

*Primary Examiner*—Richard A. Schacher

*Attorney, Agent, or Firm*—Charles R. Malandra, Jr.; Melvin J. Scolnick

[57] ABSTRACT

Translatable registration apparatus in an envelope turning machine. The apparatus includes: a deck for transporting a plurality of envelopes from an upstream location to a downstream location; a translatable carriage mounted to the deck and adjustable for upstream and downstream movement to accommodate different size envelopes; a yoke pivotably mounted at its upstream end to the carriage, the yoke having a stopping finger projecting upwardly at its downstream end; a solenoid located beneath the finger and mounted to the carriage; and a device engaging the solenoid and the yoke for moving the finger up above the deck and down below the deck, wherein, when the solenoid raises the finger above the deck, the stopping finger is locked in a raised position with no pressure bearing on the solenoid.

6 Claims, 6 Drawing Sheets

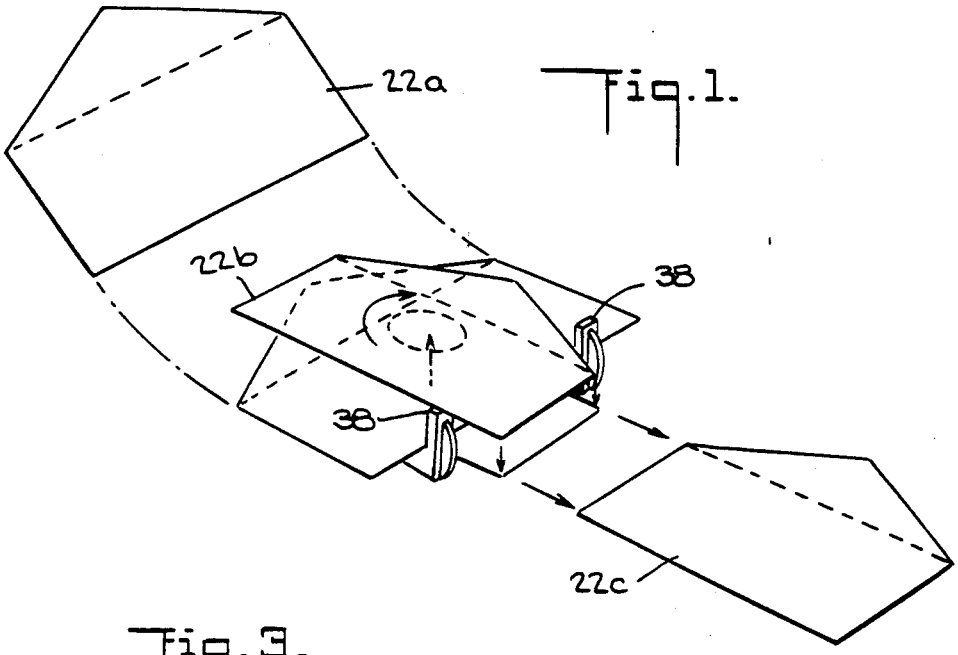
Fig. 1.
Fig. 9.
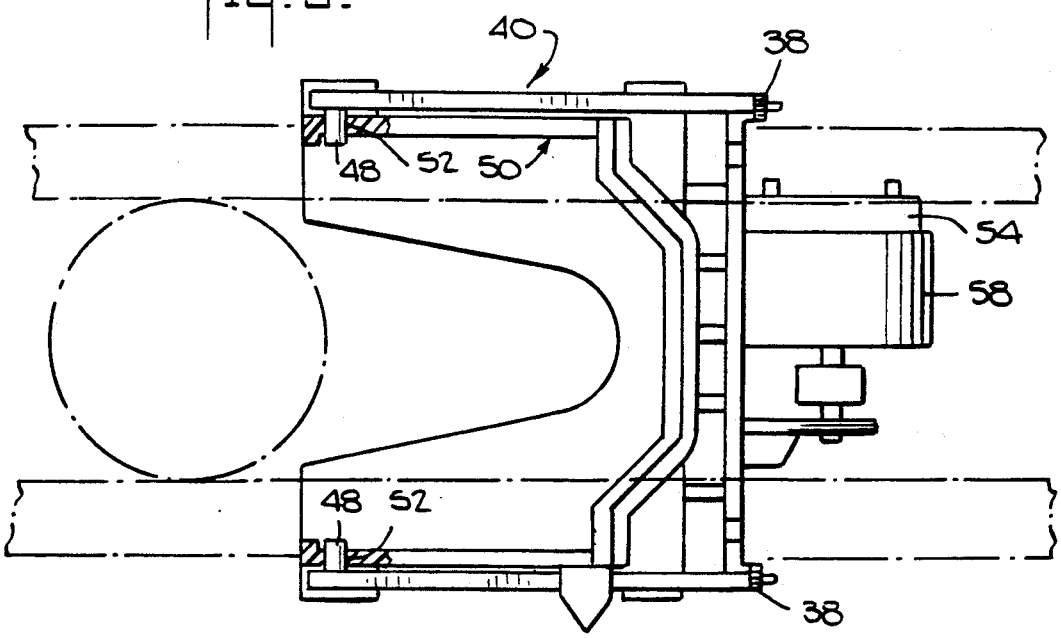

STOPPING DEVICE FOR ENVELOPE TURNER

BACKGROUND OF THE INVENTION

The instant invention relates to apparatus for stopping and aligning envelopes, and more particularly to apparatus for stopping and aligning envelopes prior to their being turned by an envelope turner.

Turning devices for flat articles that are conveyed horizontally are required in mail processing machines. Examples of flat articles include envelopes, letters, postcards, endless forms issued by a computer controlled printing device that are cut into sheets from an endless web, and the like. In an inserter and mail processing machine, sheets are fed, one by one or collected together, to a folding station and subsequently, with or without additional enclosures, are conveyed to an inserting station where the sheets are inserted into an envelope.

After insertion of the sheets into the envelope, the stuffed envelope is forwarded to a postage station where postage is imprinted thereon by a postage meter. In certain inserters, it is necessary to turn the stuffed envelopes through a 90 degree angle if the postage meter is oriented in the same direction as the discharge from the inserting station. Many types of turners are known in the prior art to effect a 90 degree turn. Many, however, turn the envelope on an edge which risks damage to the envelope and is more time consuming because a greater radius of turn is required than for a turn on the center of gravity of the envelope. Thus, apparatus was developed for turning flat articles such as envelopes on their centers of gravity through 90 degrees and removing them from the turning mechanism more quickly and efficiently than prior art devices.

An example of an envelope turner which turns envelopes on their centers of gravity can be found in U.S. Pat. No. 4,928,807 issued to the assignee of the instant invention. In such a turner, it is necessary to stop and align the envelope prior to turning the envelope. A stopping mechanism is employed which is moved into the path of travel of the envelope. After the envelope is stopped and aligned, the stopping mechanism is moved out of the path of travel so that the envelope can be further moved and turned.

Envelope turners can be used in large, console systems, or in small, table-top operations. In the case of table-top operations, in which the inserting apparatus is considerably smaller than that used in console systems, it is necessary to employ an envelope turner which is likewise compact. In order to have a compact envelope turner, it is necessary to have a stopping and aligning mechanism which can fit within the housing of the small envelope turner, and yet still be capable of being moved upstream or downstream in order to accommodate envelopes of varying size.

Accordingly, the instant invention provides a translatable stopping and aligning device for envelopes of various sizes which requires a minimum amount of space and power, and thus is ideally suited for use with a table-top envelope turner, although it may be used in any environment in which a small registration device is required.

SUMMARY OF THE INVENTION

The instant invention provides translatable registration apparatus in an envelope turning machine. The apparatus includes: a deck for transporting a plurality of envelopes from an upstream location to a downstream location; a translatable carriage mounted to the deck and adjustable for upstream and downstream movement to accommodate different size envelopes; a yoke pivotably mounted at its upstream end to the carriage, the yoke having a stopping finger projecting upwardly at its downstream end; a solenoid located beneath the finger and mounted to the carriage; and a device engaging the solenoid and the yoke for moving the finger up above the deck and down below the deck, wherein, when the solenoid raises the finger above the deck, the stopping finger is locked in a raised position with no pressure bearing on the solenoid.

BRIEF DESCRIPTION OF THE DRAWINGS

FIG. 1 is a perspective view of an envelope registration apparatus in accordance with the instant invention;

FIG. 3 is a top, plan view of the envelope turning device seen in FIG. 2;

FIG. 6 is similar to FIG. 5 except that the envelope has been turned and is being ejected from the turning device;

DETAILED DESCRIPTION OF THE PREFERRED EMBODIMENT

Figure 2:
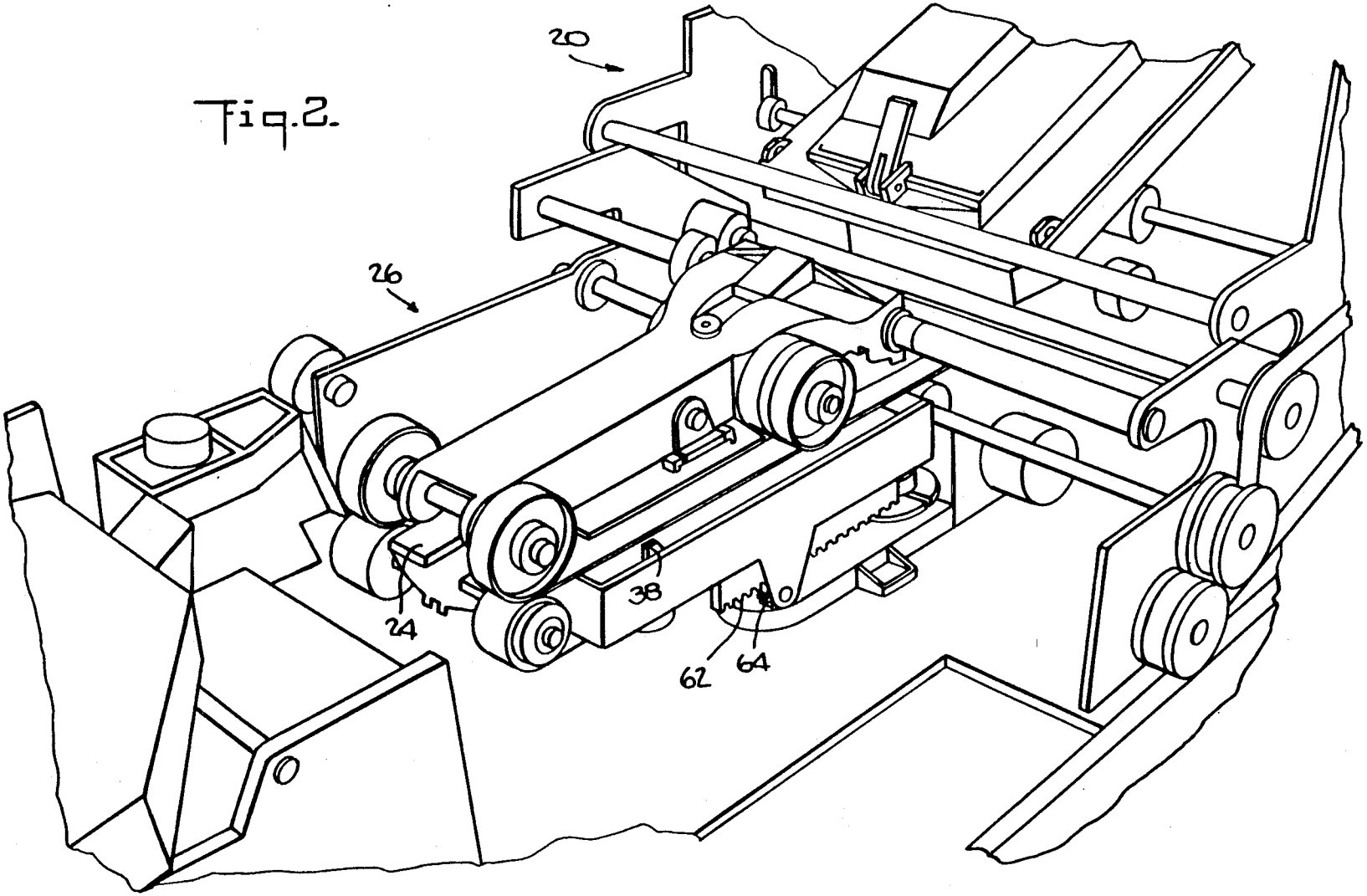
FIG. 2 is a perspective view of an envelope turning device employing the registration apparatus seen in FIG. 1.

In describing the preferred embodiment of the instant invention, reference is made to the drawings, wherein there is seen in FIG. 2 a table-top inserter generally designated 20 which feeds and inserts documents (not seen) into an envelope 22. The stuffed envelope 22 is then fed onto a feed deck 24 of an envelope turning apparatus generally designated 26.

As seen in FIG. 1, the envelopes 22 are initially fed from the inserter 20 in the alignment manifested by envelope 22*a*, i.e. the length of the envelope 22 is perpendicular to the direction of travel. Envelope 22*b* represents an envelope that has been turned by the turner 26, and envelope 22*c* represents an envelope that has been ejected from the turner 26.

Figure 4:
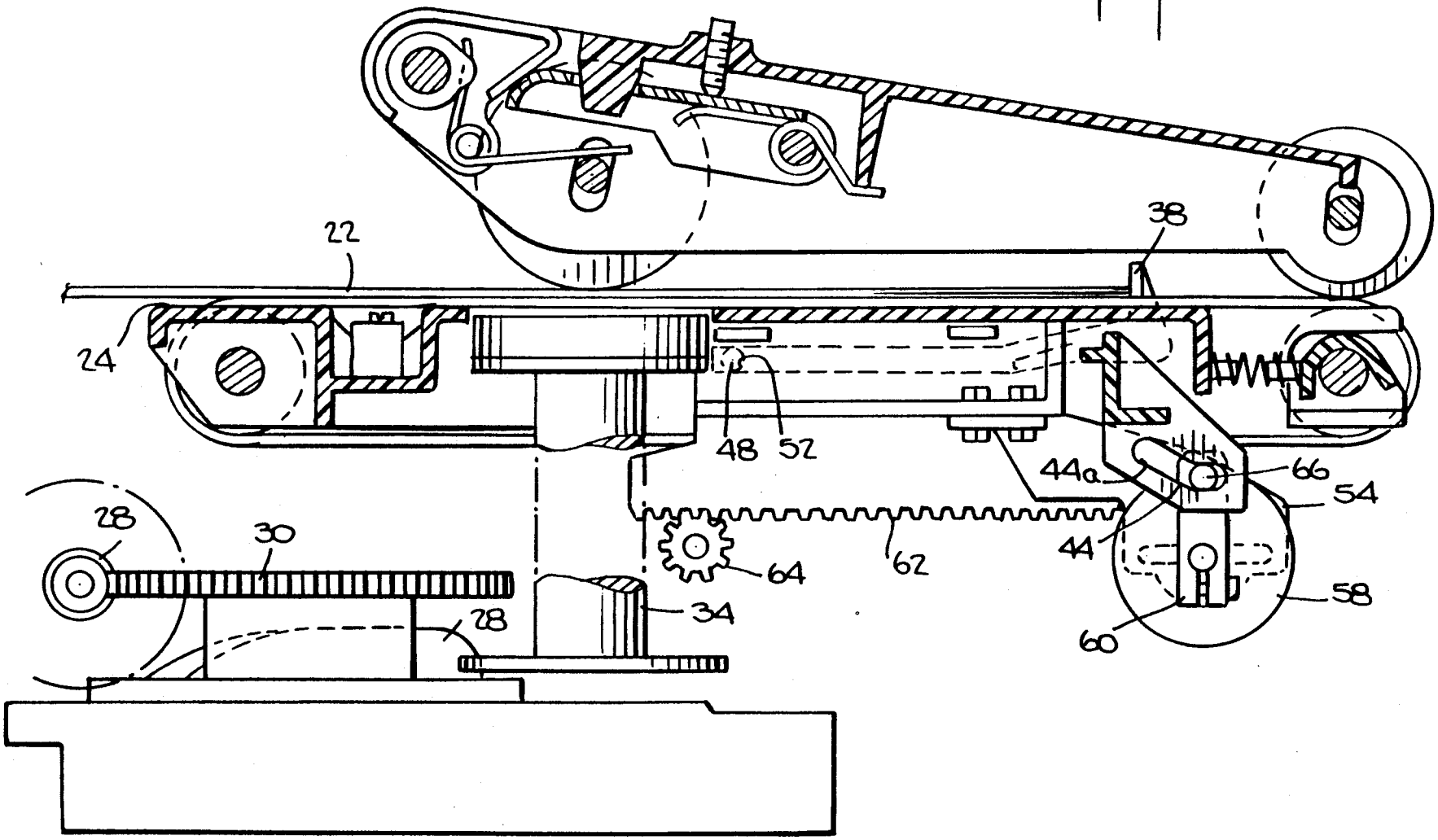
FIG. 4 is a vertical, sectional view of the device seen in FIG. 2 showing an envelope stopped and aligned by the registration apparatus.
Figure 5:
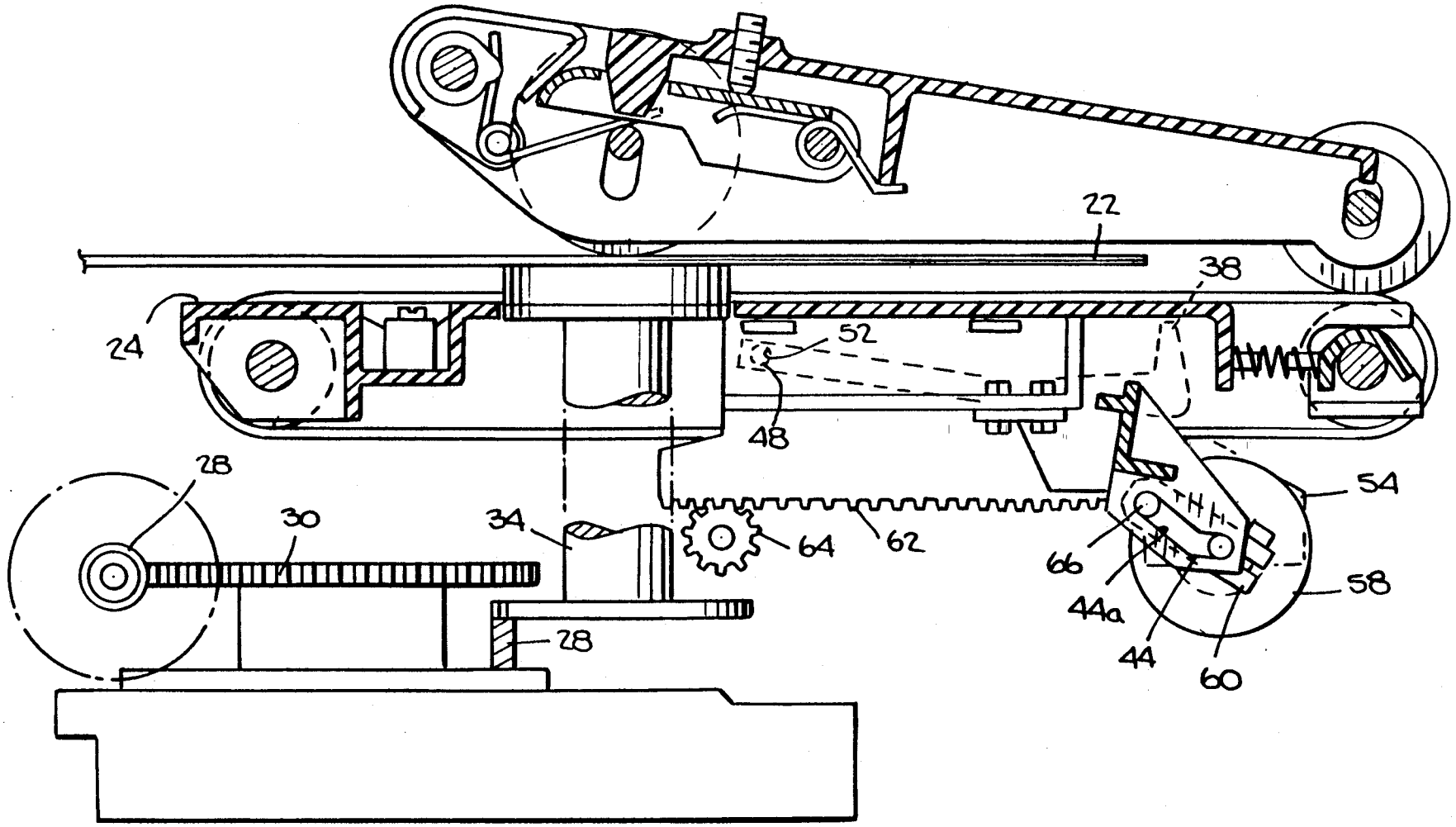
FIG. 5 is similar to FIG. 4 except the envelope registration apparatus is lowered and the envelope is elevated preparatory to being turned.
Figure 5:
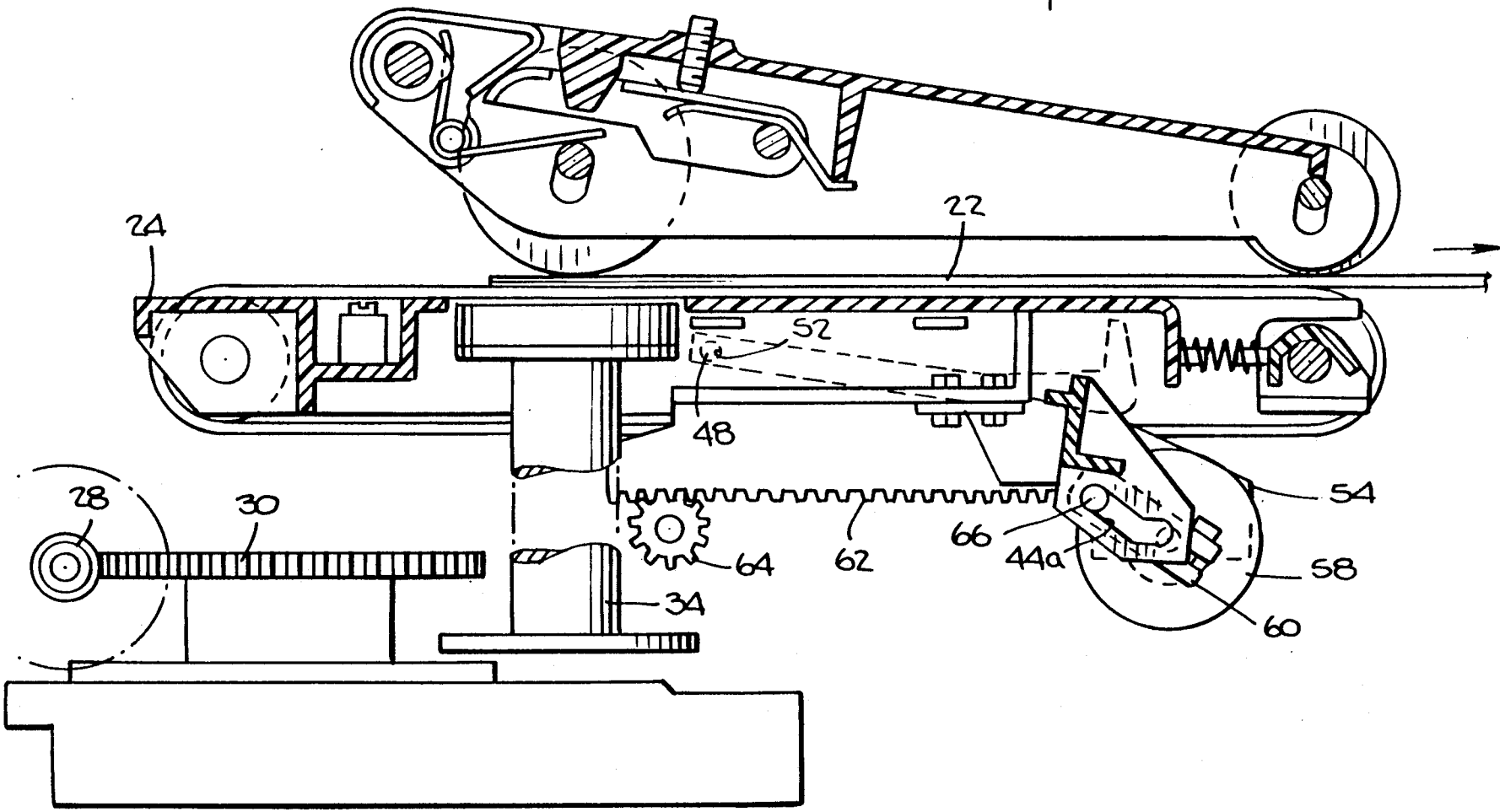

When an envelope 22 has been filled with inserted documents by the inserter 20 and sensors determine that the proper documents have been inserted, a pair of registration stop fingers 38 are raised into the position seen in FIGS. 1 and 4, and the envelope 22 is released by the inserter 20. The envelope 22 is fed to the position seen in FIG. 4 where it is stopped and aligned by the registration stops 38. Once the envelope 22 is resting against the stops 38, it is ready to be turned 90 degrees. A worm 28 drives a worm wheel 30 which is secured to a multi-function cam 32, which is rotated 360 degrees. Through this rotation, a spindle/geneva 34 is raised 0.40 inch and rotated 90 degrees. The 90 degree rotation turns the envelope 22 to align with a sealing device (not shown) downstream. Before the 90 degree rotation is effected, the stops 38 are retracted as seen in FIG. 5.

Figure 9:
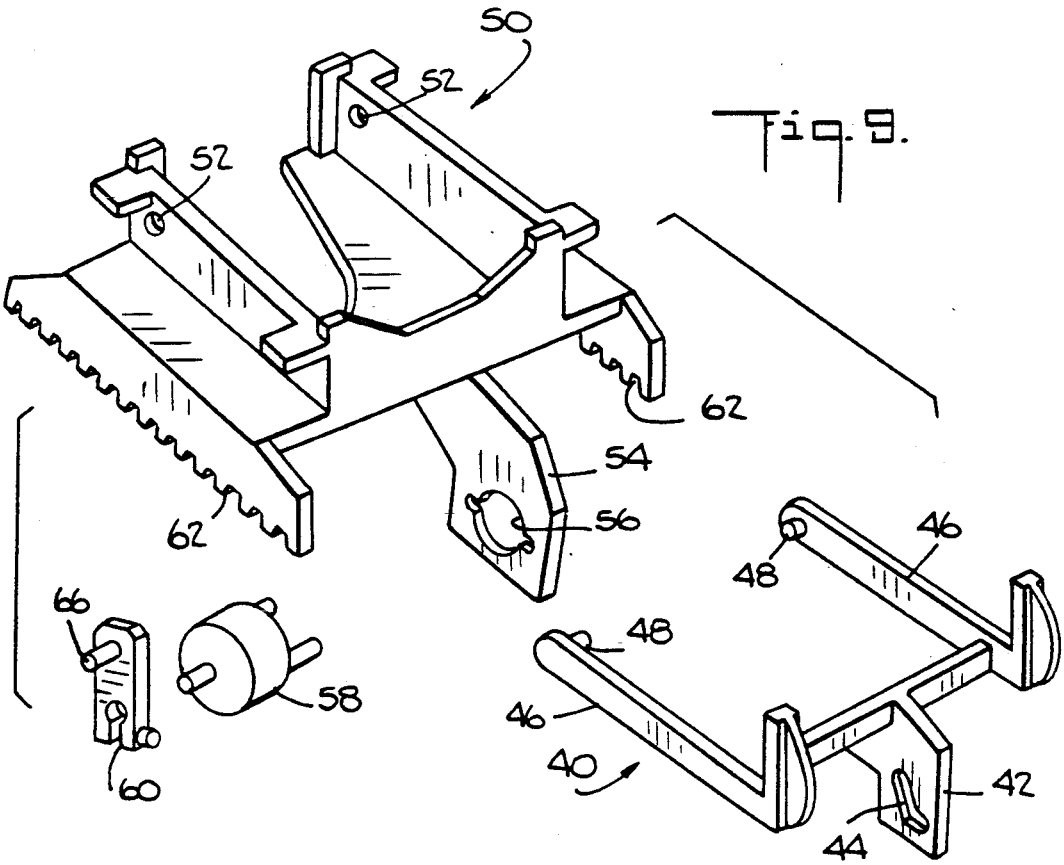
FIG. 9 is an exploded, perspective view of the envelope registration apparatus.

The stop fingers 38 are part of a yoke 40 (see FIG. 9) which also includes a flange 42 having an angled slot 44 therein. The yoke 40 includes a pair of arms 46 extending from the stops 38, and the arms 46 each include a stud 48 to be discussed further hereinbelow.

The yoke 40 is secured to a carriage 50 by means of the studs 48 engaging a pair of mating apertures 52 in the carriage 50, which is secured to the turner feed deck 24. The carriage 50 includes a bracket 54 which has an aperture 56 for receiving a solenoid 58 which drives a link 60. The carriage 50 is secured to the deck 24 and includes a rack 62 which engages a pinion gear 64 secured to the side of the deck 24. Rotation of the pinion gear 64 effects a translation of the carriage 50 and stops 38 so that the stops 38 can be set at any desired location in order to accommodate various size envelopes.

Figure 7:
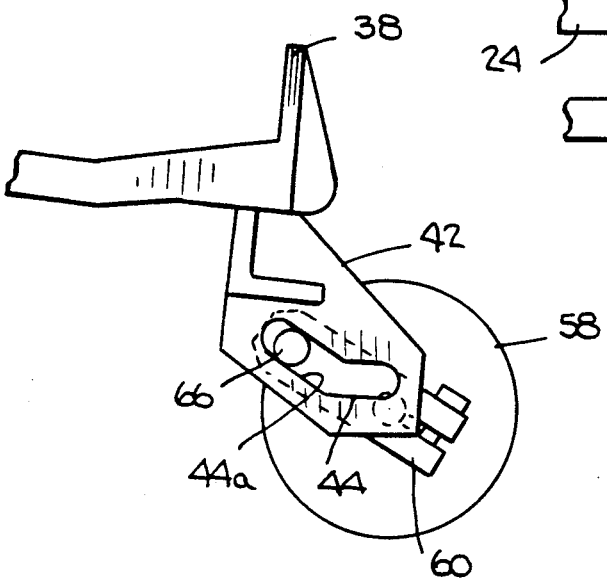
FIG. 7 is a side, elevational view of the registration apparatus seen in FIG. 1 shown in the down position.
Figure 8:
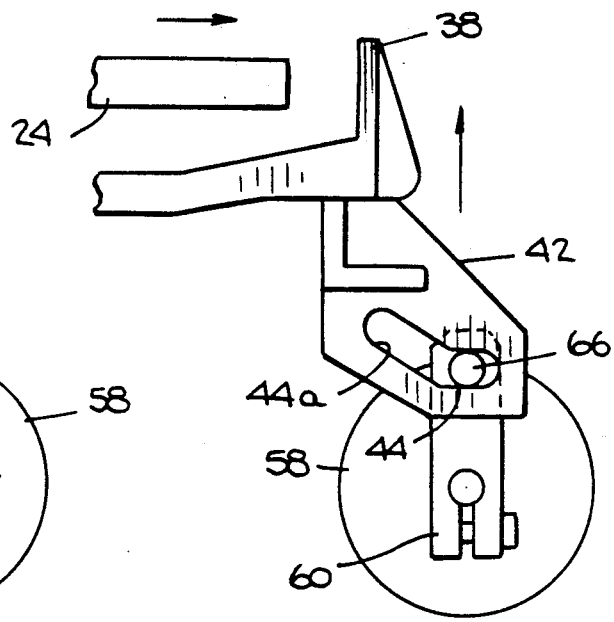
FIG. 8 is the same as FIG. 7 except the registration apparatus is seen in the up position to stop and align incoming envelopes.

The link 60 includes a pin 66 which engages the angled slot 44 of the stop yoke 40, as best seen in FIGS. 7 and 8. When the stops 38 are lowered to permit envelopes 22 to pass over the deck 24, the flange 42 is in the position seen in FIG. 7, so that the pin 66 is situated at the end of the longer channel portion 44*a*. When the stops 38 are raised to stop envelopes 22, the solenoid 58 rotates clockwise 60 degrees to effect a 60 degree rotation of the link pin 66 which compels the flange 42 to rotate to the position seen in FIG. 8. The rotation of the flange 44 and of the entire yoke 40 including the stops 38 is effected about the studs 48. The effect of the rotation of the yoke 40 is to lock the stops 38 in place owing to the geometry of the angled slot 44, and to eliminate any pressure on the solenoid 58. The stops 38 must be able to stop incoming envelopes 22 which may be up to 0.250 inch thick and moving at a velocity of 60 inches per second. The solenoid 58 is not used to stop the incoming envelopes 22; thus, a small solenoid with a small power supply is all that is required.

Although a link 60 has been interposed between the solenoid 58 and the bracket 54, other means for rotating the stops 38 may be used, such as cams, provided that the stops 38 are locked in place as with the link 60 and the slot 44.

It should be understood by those skilled in the art that various modifications may be made in the present invention without departing from the spirit and scope thereof, as described in the specification and defined in the appended claims.

What is claimed is:

1. In an envelope turning machine, translatable registration apparatus, comprising:

a deck for transporting a plurality of envelopes from an upstream location to a downstream location;

a translatable carriage mounted to said deck and adjustable for upstream and downstream movement to accommodate different size envelopes;

a yoke pivotably mounted at its upstream end to said carriage, said yoke having a stopping finger projecting upwardly at its downstream end;

a solenoid located beneath said finger and mounted to said carriage; and means engaging said solenoid and said yoke for moving said finger up above said deck and down below said deck, wherein, when said solenoid raises said finger above said deck, said stopping finger is locked in a raised position with no pressure bearing on said solenoid.

2. The apparatus of claim 1, wherein said moving means comprises a link having a pin projecting therefrom and said yoke further includes a flange having an angled slot therein for engagement with said link pin.

3. The apparatus of claim 2, wherein said yoke includes a pair of stopping fingers projecting upwardly at its downstream end.

4. The apparatus of claim 3, wherein said flange is situated substantially intermediate said pair of stopping fingers.

5. The apparatus of claim 4, wherein said carriage includes a rack for upstream and downstream adjustment.

6. The apparatus of claim 2, wherein said slot includes a pair of channels forming an obtuse angle.

* * * * *